US005752787A

United States Patent [19]

Trangsrud

[11] Patent Number: 5,752,787

[45] Date of Patent: May 19, 1998

[54] BASE OF A MANHOLE HAVING A CANAL-BED LINER

[75] Inventor: Julian P. Trangsrud, Northfield, Minn.

[73] Assignee: Royal Anchor Systems, Inc., Stacy, Minn.

[21] Appl. No.: 783,569

[22] Filed: Jan. 15, 1997

[51] Int. Cl.[6] ..... B63B 35/04

[52] U.S. Cl. ..... 405/154; 52/20; 52/21

[58] Field of Search ..... 405/36, 40, 41, 405/43, 52, 53, 154, 125; 52/19–21; 137/363, 364, 371; 210/153, 163, 164, 532

[56] References Cited

U.S. PATENT DOCUMENTS

| | | | |
|---|---|---|---|
| 1,463,461 | 7/1923 | Davis . | |
| 1,706,811 | 3/1929 | Pearson et al. . | |
| 1,712,510 | 5/1929 | Monie . | |
| 2,547,418 | 12/1951 | Turpin et al. . | |
| 2,798,504 | 7/1957 | Gast . | |
| 3,403,703 | 10/1968 | Reimann | 52/21 |
| 3,428,077 | 2/1969 | Scarfe | 405/36 X |
| 4,275,757 | 6/1981 | Singer . | |
| 4,483,643 | 11/1984 | Guggemos | 405/154 |
| 5,081,802 | 1/1992 | Westhoff et al. | 52/20 |
| 5,303,518 | 4/1994 | Strickland | 52/21 |
| 5,584,317 | 12/1996 | McIntosh | 52/21 X |

FOREIGN PATENT DOCUMENTS

| | | | |
|---|---|---|---|
| 423919 | 5/1967 | Switzerland | 52/21 |

OTHER PUBLICATIONS

GU–Manhole Liners Ltd., Jun. 1989.

"GU Lined Manholes", GU Industries Inc. (undated).

*Primary Examiner*—Tamara L. Graysay
*Assistant Examiner*—Frederick L. Lagman
*Attorney, Agent, or Firm*—Haugen & Nikolai, PA

[57] ABSTRACT

A base for a manhole or catch basin structure having an embedded plastic canal-bed liner and a corresponding hood. The plastic liner has an annular, outwardly extending flange which becomes embedded in a sidewall of the base to form a unitary structure when the concrete is poured. The liner is not subject to delamination from the canal-bed and includes bosses for additional anchoring to the base. In an alternative preferred embodiment, a seal and seal adapter are provided. The adapter, in combination with an integral socket of the canal-bed liner, restrains the seal within a canal-bed sidewall opening. This combination also serves to conveniently position the seal at time of casting. The canal-bed liner and hood serve to protect the concrete base and cone of the manhole from corrosive fluids, thus extending the useful life of the manhole structure.

22 Claims, 8 Drawing Sheets

BASE OF A MANHOLE HAVING A CANAL-BED LINER

BACKGROUND OF THE INVENTION

I. Field of the Invention

The present invention relates generally to manhole and catch-basin structures used to join sewer tubes while providing a cleaning or inspection shaft. More particularly, it relates to the base of the manhole or catch-basin having a liquid impermeable canal-bed liner and associated method to reduce exposure of the concrete base to corrosive chemicals, thus extending the useful life of the structure and hole connections formed by the canal-bed, allowing for easy connection with a rubber gasket.

II. Background of the Invention

Sanitary and storm sewer systems are typically comprised of a plurality of networked sewer pipelines. These pipelines are occasionally passed through or joined to one another at a manhole or catch-basin structure. These structure serve as a node for the sewer system, and also provides an access or inspection shaft. Devices for unclogging the sewer pipelines can be inserted into the sewer pipelines at the manhole structure location, and then guided through the pipes to remove obstructions proximate the manhole structure.

When a manhole or catch-basin is first constructed, it comprises a base with concentric sides extending upward. Resting atop the concentric sides is a pre-cast cone. A cast iron support frame and cover or grate are placed onto the top of the cone. The base and cone of the manhole structures are typically comprised of mortared blocks or casted concrete, weigh several tons, and may have diameters of 10 feet or more. The lower portion of the base of the manhole is referred to as a canal-bed. Manholes and catch basins are buried beneath the earth's surface, and typically below roadways, at depths of 10 feet or more. Of course, the overall size of the base affects both the cost to manufacture the base and the cost to construct the manhole.

The base of the manhole or catch-basin structure may include one or more openings adapted to receive a tube, and a gasket or O-ring for sealing a tube to a corresponding socket of the base. This sealing arrangement inhibits sewage from leaking about the pipes into the phreatic water or ground water adjacent the canal-bed of the base. A variety of gasket seals are known which are adapted to provide a leak-proof seal between the base and the pipe. One such gasket seal is disclosed in U.S. Pat. No. 3,796,406 which is assigned to A-Lok Corporation of Trenton, N.J. This seal has a generally A-shape and is rooted by casting splayed legs into the upwardly extending concentric sides of the base about the opening formed therein. Another type of gasket is disclosed in U.S. Pat. 4,159,829, also assigned to A-Lok Corporation. This seal has a generally T-shaped anchoring flange and is also cast into the sides of the base about the opening. These gaskets can be difficult to orient during the casting of the base.

Once the manhole or catch basin is constructed, the fluids passing through tend to deteriorate the structure. For example, sewage and putrid water are very acidic, and may comprise hydrogen sulfide and sulfuric acid. Over time, exposure to sewage or putrid water can damage the concrete of the canal-bed, base, and cone. In catch basins, road salt also has the same affect on the canal-bed. This is due to the eventual breakdown of the concrete by the road salt, especially if the concrete is of poor quality. When repair or replacement of these manhole/catch basin structures is required, due to a deteriorated canal-bed, base or cone, the procedure is extremely expensive, time consuming, and difficult.

To meet the need of increasing the useful life of these structures and to protect the canal-bed, plastic liners or shells with integrally defined canals have been developed. One such canal-bed shell is disclosed in U.S. Pat. No. 4,483,643 to Guggemos. Guggemos describes building sewers or channels by assembling tubes and providing between the tubes canal-bed shells at least at those positions where cleaning shafts or wells or inspections shafts are to be provided. The canal-bed shell disclosed by Guggemos is either cast onto and upon a bed of concrete, or subsequently anchored thereto. A shaft is then erected above the canal-bed. Guggemos describes using a jointing compound or the like between the shaft and canal-bed to seal the canal-bed and avoid contamination of phreatic water. These jointing compounds may deteriorate, be misaligned or separate from the shaft and canal-bed liner, thereby increasing the risk of contamination to the phreatic water.

In the device disclosed by Guggemos, the depth of the canal is disclosed as being equal to or greater than the interior diameter of the sewer pipes coupled thereto. By requiring the height of the canal-bed shell to be at least greater than the internal diameter of the pipes or sewer tubes, a substantial amount of additional concrete or other material is required. This substantial amount of additional concrete increases the cost to manufacture, increases the overall weight of the canal-bed, and increase the cost of constructing the manhole. Hence, there is a need for a lined canal-bed or base of reduced weight that provides sufficient flow guidance within the canal-bed ans seals completely with a corresponding pipe. The present invention meets these needs and overcomes these and other disadvantages of the prior art.

OBJECTS

It is accordingly a principal object of the present invention to provide a liquid impermeable canal-bed liner for use in a manholes or catch basin, wherein the liner is cast within the base and includes a relatively round opening extending through the base for sealably engaging an adjacent pipe.

Another object of the present invention is to provide a canal-bed having a liner that guides a sufficient amount of fluid therethrough, while reducing the weight of the base and canal-bed.

A further object of the present invention is to provide an improved canal-bed liner and gasket arrangement for coupling sewer pipes thereto, wherein the liner is not subject to delamination from the base.

Still another object of the present invention is to provide an improved method of integrating a plastic canal-bed liner and sealing gasket into a casted concrete base.

Yet another object of the present invention is to provide a method of constructing a one-piece base having a canal-bed liner which does not facilitate build-up of solid sewage and resulting clogging.

These and other objects, features, and advantages of the present invention will become apparent to those skilled in the art through a reading of the following detailed description in conjunction with the accompanying claims and drawings keeping in mind that like numerals in the several views refers to the same corresponding parts.

SUMMARY OF THE INVENTION

In accordance with the present invention, the foregoing objects and advantages are achieved by providing the canal-bed of the base of a manhole structure with a liquid impermeable liner having a peripheral flange and at least one socket extending into the sidewall thereof The socket is aligned with a channel of the canal-bed. The channel has a depth that is approximately one-half the diameter of the wall opening. In conjunction with the liner, a hood is provided that directs corrosive gases, including hydrogen sulfide, towards the liner and away from the sidewalls of the base and cone of the manhole.

During the casting process, inner and outer concentric molding walls are used to form the upwardly extending concentric sides of the base or canal-bed. A bottom molding wall attaches to the outer molding wall and an inner sidewall of the liner engages with the inner molding sidewall. In this manner, when concrete is poured into the mold, the flange of the liner becomes embedded into the poured concrete and thus is not subject to delamination.

During this casting process, a plug or insert is disposed in the socket of the liner and extends therefrom to the outer molding sidewall. The plug prevents distortion of the round socket from the weight of the concrete. The plug also creates and forms a round opening extending through the sidewall of the base adjacent the channel of the canal-bed. Once the poured concrete has set, the plug may be removed, thereby defining the opening in the sidewall of the base through which sewer pipes can enter. A flexible annular seal member may be disposed in this opening between the liner and the sewer pipes. In this manner, the leakage of fluids out of or alternatively into the sewer system is substantially reduced. In several embodiments of the present invention, a liner is provided having two or more sockets extending through the base sidewall and are in communication with the cannel-bed channel. Preferably, both the liner and the insert are formed of molded plastic material.

In an alternate embodiment, the liner has at least one integral pipe-receiving socket extending partially into the structure sidewall opening. The socket is positioned adjacent an annular seal, and in combination with an annular insert, restrains the annular seal within the opening. Preferably, an outer perimeter of the seal has an L-shape which is pinched between the liner socket and the opening insert. This liner socket has a shoulder portion defined between the seal and the channel. When installed, a sewer tube or pipe is abutted against this shoulder to provide a stepless interface between the tube inner surface and the liner channel.

A method for forming the unitary concrete canal-bed structure having a gasket molded therein is disclosed and includes: first, providing a vertical mold column having a top surface. Next, a liquid impermeable liner having at least one pipe receiving socket is positioned across the top surface of a mold column such that a periphery of the liner extends radially beyond the mold column top surface. Thereafter, a mold outer wall is provided about the vertical mold column to define a spacing therebetween. This mold outer wall extends above the mold column top surface. Then, concrete is poured into the spacing to fill it. The extending portion of the liner is thus embedded in the concrete. After allowing sufficient time for the concrete to harden, the mold column and mold outer wall are removed from the casted canal-bed structure. The seal and seal adapter are attached to the liner socket before pouring the concrete. This method allows the seal to be accurately positioned within an opening commnunication with the liner socket.

DESCRIPTION OF THE PREFERRED EMBODIMENT

Figure 1:
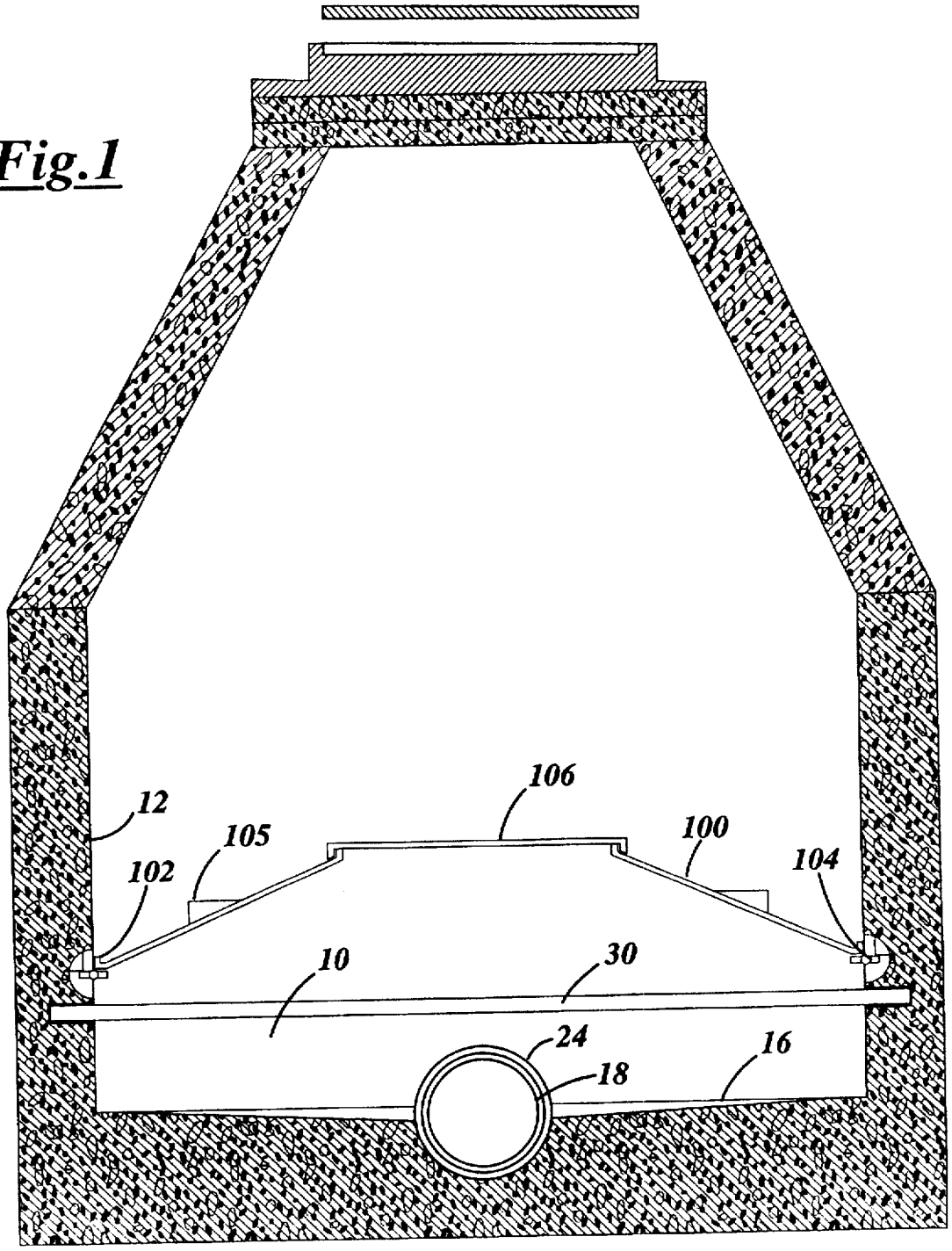
FIG. 1 is a partial sectional view of a canal-bed, canal liner, cone, a pair of spacer members, a support frame and manhole cover all aligned and engaged.

Referring first to FIG. 1, there is shown generally a canal-bed liner 10 embedded in a base 12 of a manhole structure. A conical shaped hood 100 and cap 106 is shown positioned within the manhole structure proximate the canal-bed liner 10. The hood 100 and cap 106 is preferably manufactured from polyethylene, polytetrafluoroethylene or other similar fluid impermeable, chemically inert polymer. The hood is preferrably conically shaped with an opening near the apex. A cap 106 is adapted for sealably enclosing the opining in the hood 100. The cap 106 may be removed to allow visual inspection of the canal-bed without removing the hood 100. The hood 100 rests on footrests or kickplates 104 of known construction that are anchored within the sidewall of the base 12. A lip 102 is formed along an outer edge of the hood 100, wherein the lip 102 engages the sidewall of the base 12. A caulking, such as butyl rope, may be used to seal the lip 102 of the hood 100 to the base 12. In this manner, hydrogen sulfide will be directed towards the liner 10 and generally contained within the canal-bed, thereby reducing the likelihood of deterioration of the base and cone as a result of exposure to hydrogen sulfide. Steps 105 extend from an outer surface of the hood and provide footing for one inspecting the canal bed liner 10. Those skilled in the art will appreciate that supports (not shown) may be positioned between the hood 100 and liner 10, to thereby support the hood 100 if phreatic water leaks into the manhole structure through the cone or base plate.

Figure 2:
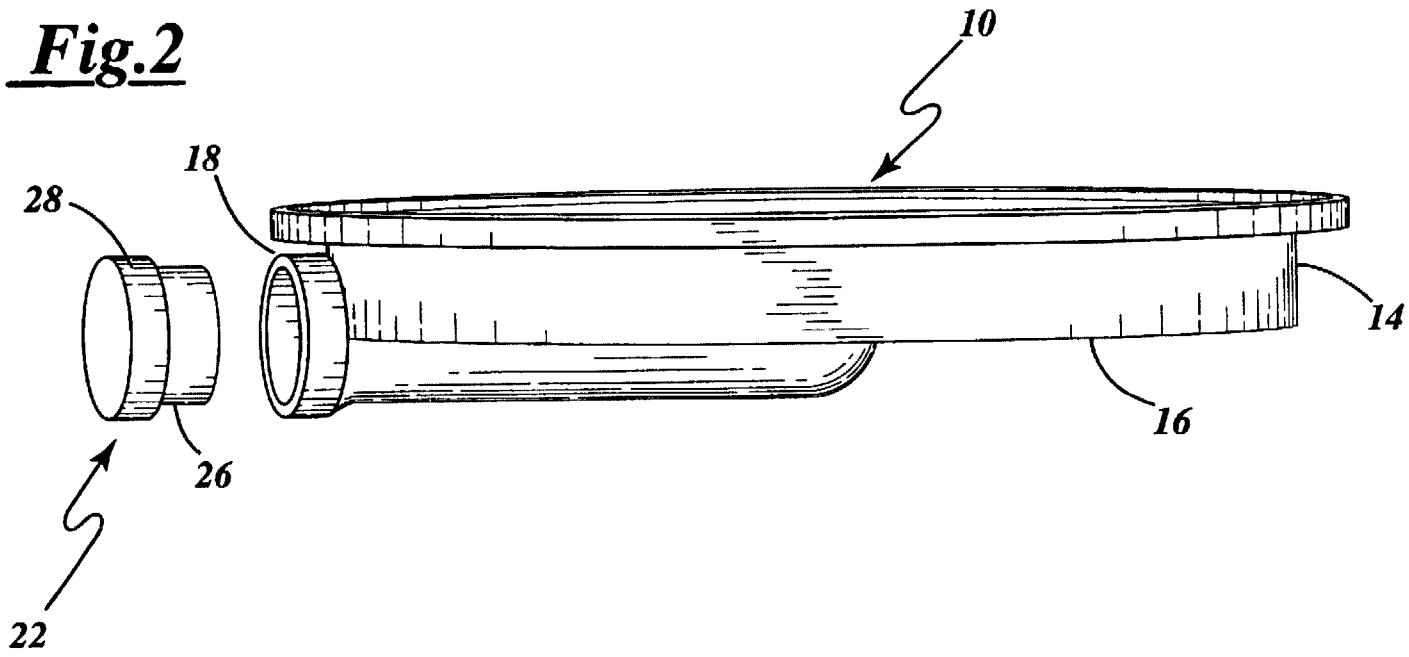
FIG. 2 is a perspective view of a molded plastic canal-bed liner in accordance with one embodiment of the present invention.

FIG. 2 shows the canal-bed liner 10 prior to being embedded in the base 12. The canal-bed liner 10 is generally dish shaped and includes an annular sidewall 14 and sloped bottom 16 to thereby form a liquid protective layer over the internal bottom of base 12. At least one socket 18 is formed within the annular sidewall 14 of the canal-bed liner 10. The socket 18 is adapted to receive, for example, a sewage pipe 20 (see FIGS. 3 and 4).

During the casting process, which is described below in greater detail, a cylindrical plug 22 is used to prevent deformation of the socket 18 and to further define an opening 24 (see FIGS. 2–4) in the base 12. The cylindrical plug 22 includes a first cylindrical portion 26 having an outer diameter which approximates the internal diameter of the socket 18 and a shoulder 28 having a second outer diameter which is larger than the first diameter 26 and forms the opening in the base 12.

During casting, the canal-bed liner 10 is formed integral with the base 12. The annular sidewall 14 of the canal-bed liner 10 includes an outwardly protruding flange 30 which is embedded within the base 12 during the casting of the base 12. Preferably, the canal-bed liner 10 is comprised of ¼" thick polyethylene, but could be formed from other well known fluid impermeable materials. Hence, limitation to using polyethylene is not to be inferred.

Figure 3:
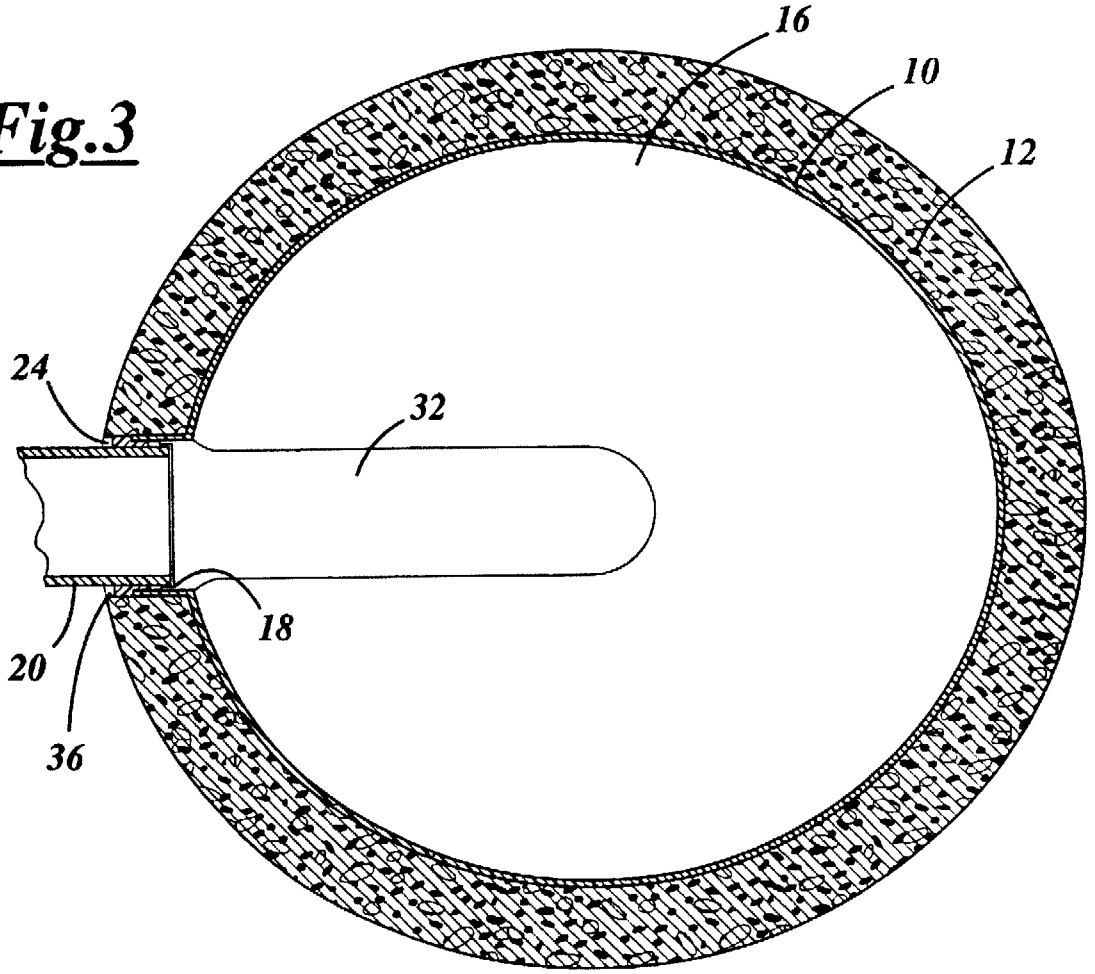
FIG. 3 is an enlarged partial sectional top planar view of the canal-bed liner of the type shown in FIG. 2.
Figure 4:
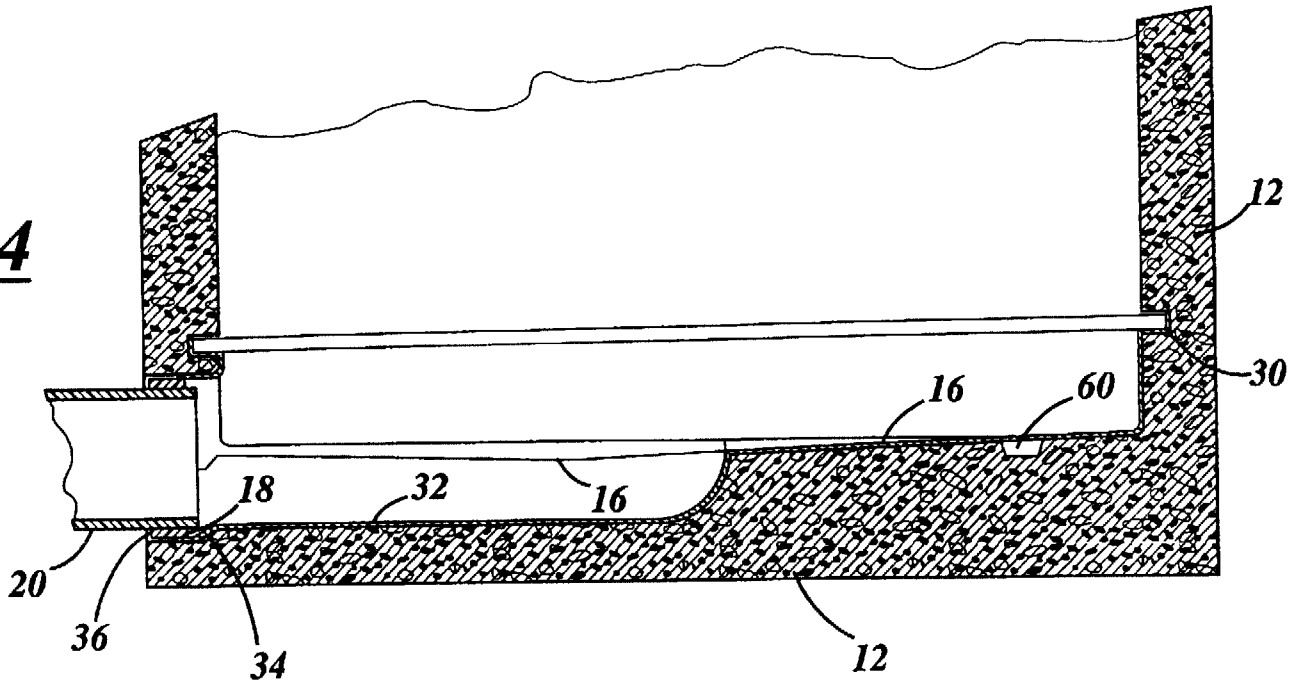
FIG. 4 is an enlarged partial sectional side elevational view of the canal-bed liner in accordance with one embodiment of the present invention, positioned within the base of a manhole structure and having a sewage pipe inserted into the canal-bed liner.
Figure 6:
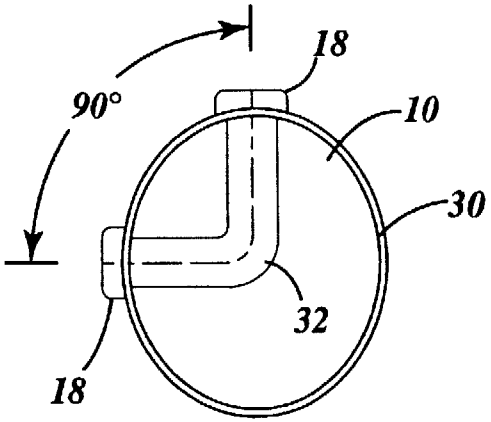
FIG. 6 is a top plan view of a molded plastic canal-bed liner in accordance with one embodiment of the present invention having two sockets separated by 90°.

Referring also to FIGS. 3 and 4, the bottom 16 of the canal-bed liner 10 is seen to slope toward a channel 32 formed in the bottom 16 of the liner 10. Extending from the bottom 16 of the liner 10 is a plurality of bosses 60. Rods may be screwed into the bosses 60, to thereby secure the bottom portion of the liner 10 to the concrete base 12. The channel 32 has a semi-circular cross section with a depth of about one-half the inner diameter of pipe 20. A tapered shoulder 34 is formed between the socket 18 and the channel 32 to provide a stepless interface. The depth of channel 32 meets American Society for Testing and Materials (ASTM) specifications which requires that the channel depth be at least half the width of the pipes connected thereto.

When pipes 20 are disposed within the socket 18, an end of the pipe abuts the tapered shoulder 34, such that the longitudinal portion of the inner surface of the pipe 20 is flush with the bottom surface of channel 32. Accordingly, sediment and other waste will not build up at this interface, and a smooth transition for liquid flow is provided. Therefore, liquid flow entering base 12 from a pipe 20 will flow unimpeded through base 12, via channel 34, to an outlet or second opening 24.

FIGS. 3 and 4 show a sewer pipe 20 sealingly adapted to the socket 18 and opening 24 defined through the base 12. A sealing gasket or seal 36 is shown disposed about the end of each pipe 20, each gasket 16 being sealingly positioned against the base 12 sidewall within respective opening 24 and the inner surface of socket 18. Gaskets 36 serve to prevent phreatic water from becoming contaminated with sewage or contaminating liquids passing through pipes 20 into the base 12. Gaskets 36 may be an expandable press fit type of known construction and readily available from NPC, Inc. of Milford, N.H. Each seal 36 is urged against the inner surface of its respective plastic socket 30, within respective openings 14. Thus, sewage or storm water passing through pipe 12 cannot come into contact with the cast concrete defining the openings 24.

Figure 8:
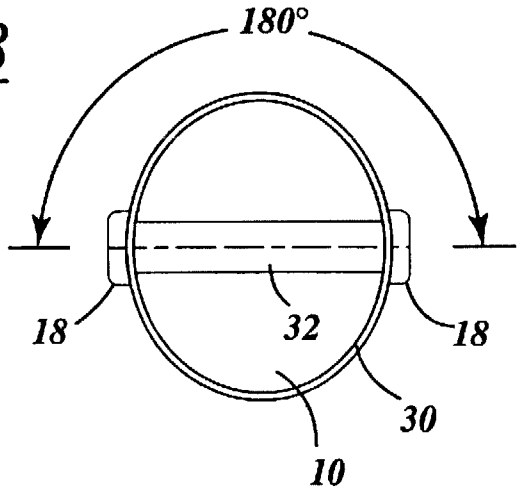
FIG. 8 is a top plan view of a molded plastic canal-bed liner in accordance with one embodiment of the present invention having two sockets separated by 180°.
Figure 5:
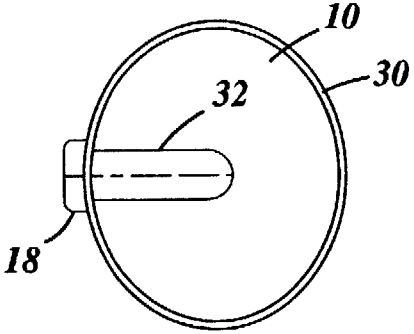
FIG. 5 is a top plan view of a molded plastic canal-bed liner in accordance with one embodiment of the present invention.
Figure 7:
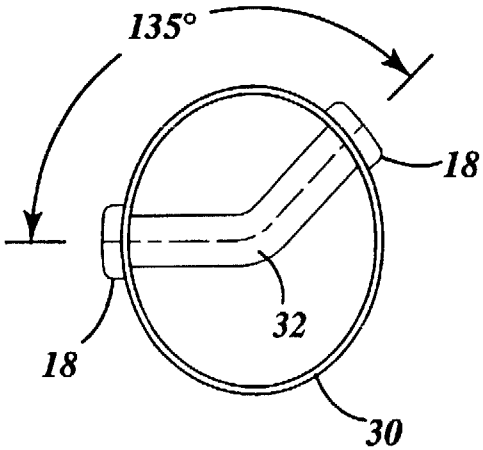
FIG. 7 is a top plan view of a molded plastic canal-bed liner in accordance with one embodiment of the present invention having two sockets separated by 135°.

Those skilled in the art will appreciate that more than one opening 24 and socket 18 may be formed in the base 12. FIGS. 5–8 illustrate several embodiments of the canal-bed liner 10 having one or more sockets 18. When two or more openings 24 and sockets 18 are provided, the channel 34 extends between opposed sockets 18 to define a liquid path which guides liquid from one socket to the other. While a pair of opposing sockets 18 with a linear channel 34 extending therebetween is shown in FIG. 8, it is to be recognized that channel 34 can be curved, for instance, between 90° and 180° degrees, to effectively re-route the direction of flow for the liquid. It is recognized that in another embodiment, channel 34 can be formed into a Y-shape channel to divide and redirect sewage or other liquids. Sewage would enter one socket, and exit out two output sockets or vice-versa. In still yet another embodiment, channel 34 can terminate at a center of liner 10 (as shown in FIG. 5) such that liner 10 has only one output socket 18 serving as an input/output port. Accordingly, limitation to the number of sockets 18, or the shape of channel 34 implemented, is not to be inferred. Rather, implementation of a plastic canal-bed liner 10 having upper peripheral flange embedded within the base 12 to inhibit delamination is one of the principle teachings of the present invention.

Figure 9:
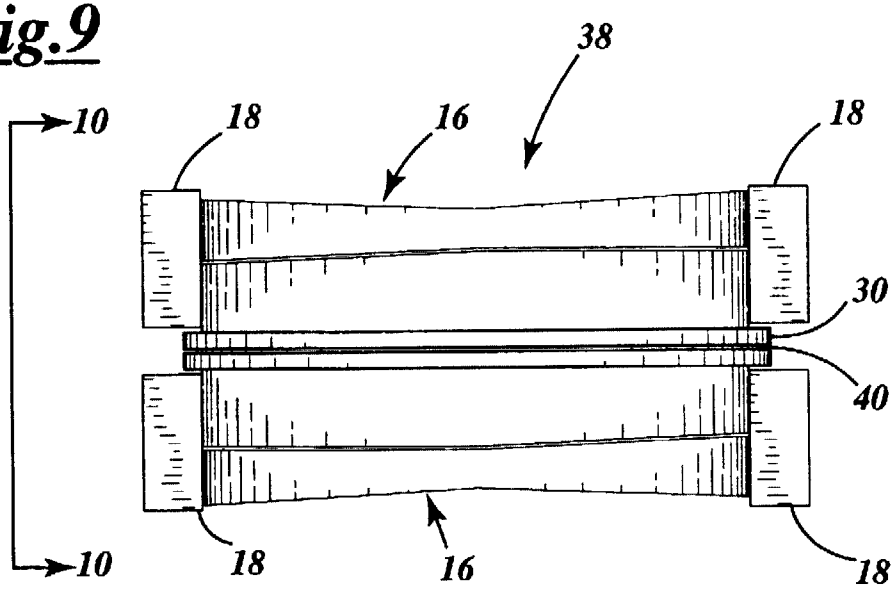
FIG. 9 is an elevational view of two plastic canal-bed liners of the type shown in FIG. 1, formed back-to-back with one another as removed from a mold and prior to separation.
Figure 10:
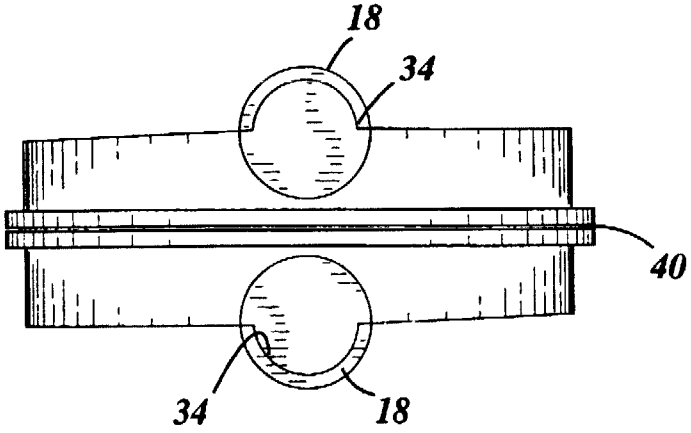
FIG. 10 is an end view taken along line 10—10 in FIG. 9, illustrating the pipe sockets formed integral to the respective liner.

Referring now to FIGS. 9 and 10, plastic canal-bed liners 10 are shown to be formed in pairs in a molding operation. They are molded as a single unit 34, back-to-back with the other. The flange 30 of each liner 10 interfaces with the other, the flanges 30 being separated by an indented annular groove 40. After molding, using well known molding techniques such as rotational molding, each of liners 10 is separated from the other by cutting along guide groove 40 extending therebetween to create two identical liners. Groove 40 facilitates lining up a cutting member, such as a saw, and helps achieve a straight cut to separate the two identical liners from one another.

FIG. 10 shows the circular openings of sockets 18. As can be appreciated from FIGS. 9 and 10, the bottom surface of channel 34 is seen to taper slightly upwardly in going from socket 18 to the midsection of liner 10. Channel 34 is the shallowest at a midsection thereof. Hence, if flow should be reduced to zero, sewage would be caused to remain standing within pipes 20, and not upon liner 10 or within the base 12.

Figure 12:
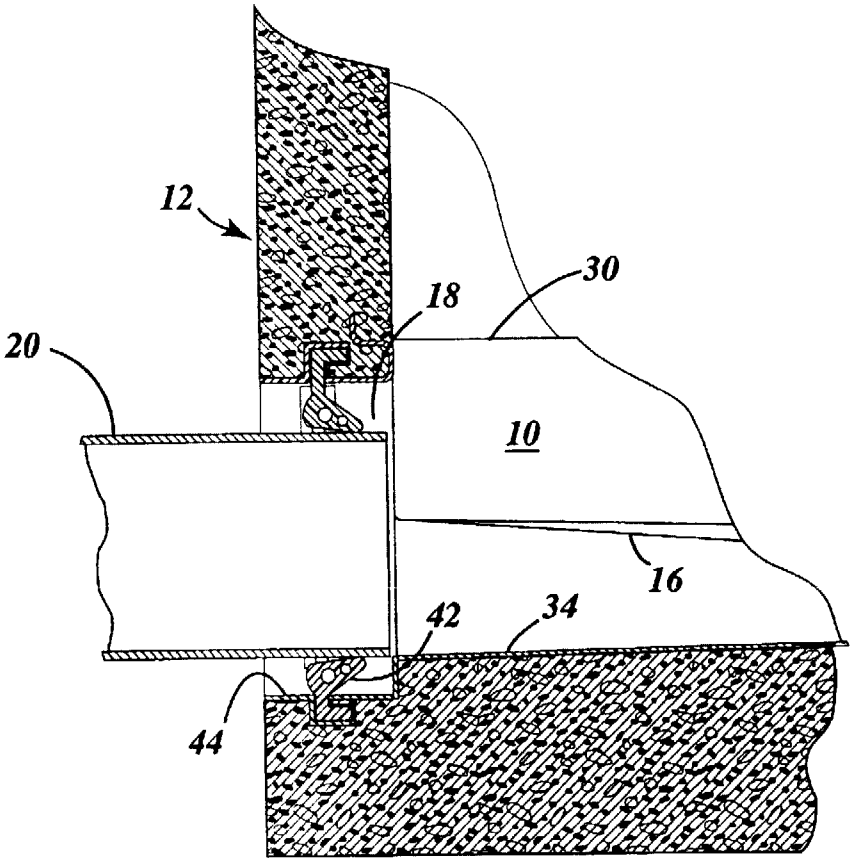
FIG. 12 is the arrangement of FIG. 11 with a sewer pipe sealingly connected in the pipe socket of the canal-bed structure, wherein the inner surface of the pipe is positioned flush with the bottom of the lined canal-bed channel.
Figure 11:
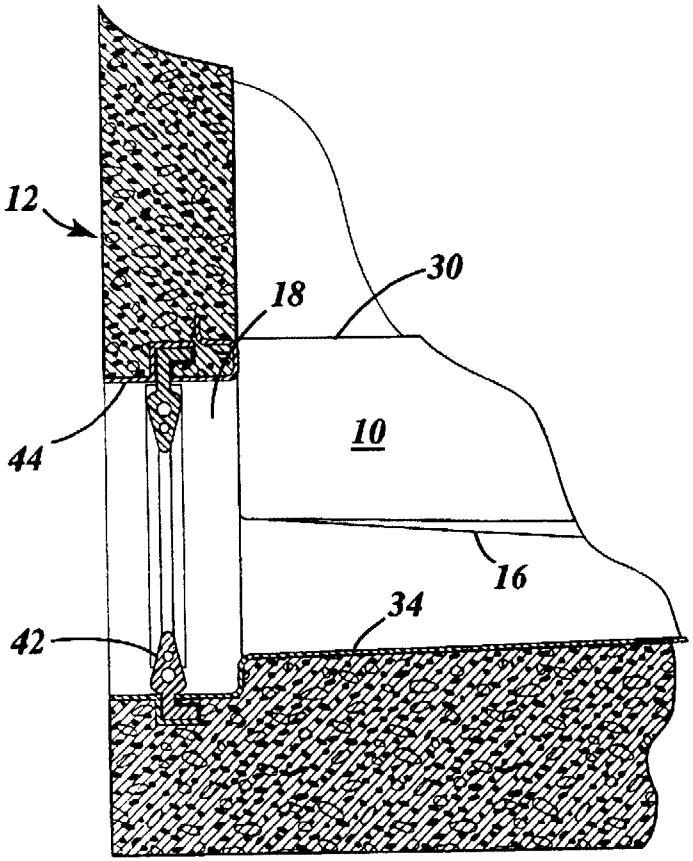
FIG. 11 is a partial sectional view of an alternate embodiment having a different pipe sealing arrangement from that shown in FIG. 1, where a seal adapter ring is formed integral to the pipe opening of the concrete manhole structure, and where a seal is interposed between the adapter ring and the canal-bed liner pipe socket.

Referring now to FIGS. 11 and 12, an alternate embodiment having seal arrangement for use with the embedded plastic liner 10 of the present invention is shown. An annular, liquid-impermeable seal 42 is provided which is cast into and lines opening 24 of the base 12. The annular seal 42, formed of vulcanized rubber, is seen to be interposed and secured between the opposing adjacent ends of lip seal adapter 44 and socket 18 of liner 10. Seal 42 extends radially inwardly within opening 24, and is adapted to bend or flex and sealingly engage against the outer surface of pipe 20 when it is inserted within opening 24. (See FIG. 12). The lip of seal 42 has a generally A-shaped cross section. When pipe 20 is inserted within opening 24, a large contact surface is formed between seal 42 and pipe 20 to effectively prevent liquids from leaking into the phreatic water.

The combination of seal 42, liner 10, and lip seal adapter 44 are all integrated into the base 12 at the time it is cast. (See FIG. 13). The combination of adapter 44 and liner 10 serve to provide a liquid impermeable lining for the internal surface of base 10 which would otherwise be exposed to the sewage. The combination of adapter 44 and liner 10 further serve to align and restrain seal 42 within opening 24 of base 12. Thus, at the time of casting the concrete base 12, seal 42 will be properly oriented, and cannot slip or become misplaced within defined opening 24. Adapter 44 and liner 10 essentially pinch annular seal 42 therebetween to hold it in place.

Figure 13:
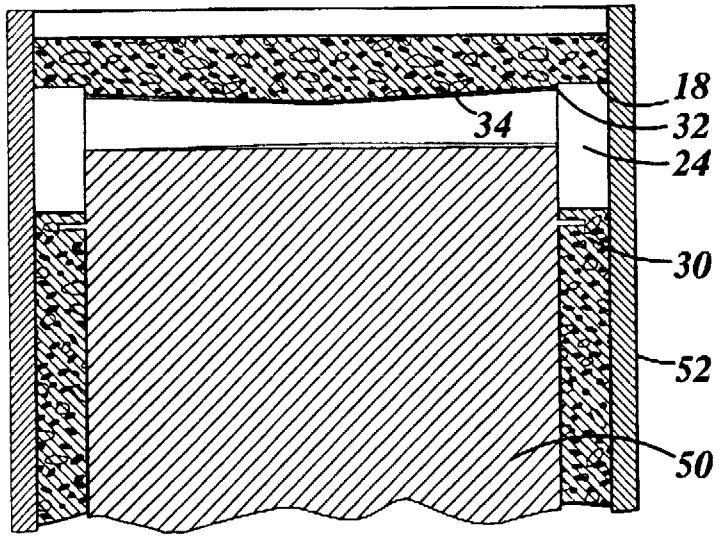
FIG. 13 is a side sectional view of the casting assembly used to cast the canal-bed structure, with the plastic canal-bed liner embedded therein, the structure being formed in an inverted position.

Referring now to FIG. 13, the method for manufacturing base 12 using the liner 10 of FIGS. 9 and 10, but which is also used to form a canal-bed structure according to the preferred embodiment of the invention in FIGS. 1–4, will be discussed. Liner 10 is cast within base 12 by first placing liner 10, in an inverted position, upon a cylindrical pedestal 50 (forming the inner sidewall of the base 12) having a conforming and identical diameter. Seal 42 and lip seal adapter 44 are subsequently inserted into the respective sockets 18. Next, a cylindrical, rigid, tubular mold member 52 (forming the outer cylindrical sidewall of the base 12) is placed about liner 10 and pedestal 50 such that the outermost ends of each socket 18 of liner 10 engage the inner walls of mold member 52, as shown. In molding the preferred embodiment, the outermost end of the plug 22 engages the inner wall of mold member 52. Thus, a opening 24 is defined between mold pedestal 50 and the inner walls of mold member 52. As can be seen, the flange 30 of liner 10 is disposed between the pedestal 50 and mold member 52, and also extends downwardly into the spacing.

Liquid concrete is poured within the spacing and allowed to harden. Accordingly, the annular lip or flange 30 of liner 20 will be embedded within the concrete wall of structure 10. After the concrete is allowed to cure over predetermined and sufficient amount of time, pedestal 50 and mold member 52 are removed to release the unitary canal-bed or base 12 with liner 10 embedded therein. As mentioned earlier, flange 30 is embedded within the walls of base 12. Hence, liner 10 cannot delaminate from the inner walls thereof.

In summary, an improved canal-bed or base is disclosed for use in a manhole structure with a hood and a corresponding, embedded canal-bed liner which is not subject to delamination. The liner is embedded in the structure when cast to provide a unitary structure. In an alternative preferred embodiment, a liner assembly with a gasket interposed between the liner and opening in the base is disclosed. This arrangement allows the gasket to be accurately positioned within the pipe opening at time of casting, and also allows the seal to be formed integral to base 12. The lip seal adapter also serves to line the pipe opening, thereby protecting the concrete. Both the gasket seal adapter, and the canal-bed liner, are formed in pairs and molded as a single unit. Each pair of members is formed back-to-back with one another, and are subsequently cut into two identical pieces after molding. A variety of plastic canal-bed liners can be formed according to the preferred embodiment of the present invention, having channels which are straight, curved, terminating in the center of the canal-bed, or having a Y-shape to split or divert a liquid flow from one pipe to two pipes.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

I claim:

1. A base for use in a manhole structure, said base comprising:

a unitary support having a vertical cylindrical sidewall and a bottom surface, wherein the bottom surface has a channel defined therein and the sidewall has at least one opening extending therethrough and communicating with the channel;

a fluid impermeable liner disposed across said bottom surface of said unitary support and conforming to the contour thereof including said channel, said liner including an outer edge extending radially outward from said liner and having an upper and lower surface of the outer edge embedded in said sidewall; and a hood aligned above said fluid impermeable liner and having an outer perimeter edge engaged to said sidewall of said base.

2. The base as specified in claim 1, wherein said liner has an annular wall disposed adjacent said sidewall.

3. The base as specified in claim 1, wherein said hood has an opening formed in said hood to allow inspection of said liner from above said hood.

4. The base as specified in claim 1, wherein the depth of said channel is approximately one-half the diameter of said sidewall opening.

5. The base as specified in claim 1, wherein said channel has an arcuate cross section.

6. The base as specified in claim 1, wherein said liner has an integral socket extending partially into said sidewall opening.

7. The base as specified in claim 1, wherein said sidewall has a second opening in communication with said channel.

8. The base as specified in claim 1 wherein said liner is formed of a fluid impermeable molded polymer material.

9. A canal-bed liner for use in a concrete base of a manhole structure, said liner comprising:

a hollow fluid impermeable cylinder including a vertical cylindrical sidewall and having a relatively planar enclosed bottom, said sidewall having an opening extending therethrough, wherein a channel is formed in said bottom and at least one socket extends from an inner surface of said sidewall into said opening such that a bottom portion of the opening is aligned with a bottom portion of said socket;

a flange radially extending outwardly from an upper edge of the vertical sidewall such that both an upper and lower surface of said flange is adapted to be embedded in the base; and at least one boss extending downwardly from a lower portion of said bottom portion, wherein said boss is adapted to be anchored to the base.

10. The liner as specified in claim 9, wherein the depth of said channel is approximately one-half a diameter of said sidewall opening.

11. The liner as specified in claim 9, wherein said channel has an arcuate cross section.

12. The liner as specified in claim 9, wherein said socket may be plugged during a formation of the base, whereby a relatively round opening may be formed in the base extending through the base.

13. The liner as specified in claim 9, wherein said sidewall has a second socket in communication with said channel.

14. The liner as specified in claim 9 wherein said liner is formed of a fluid impermeable molded polymer material.

15. A canal-bed for use in a manhole structure, said canal-bed comprising:

a unitary base having a vertical cylindrical sidewall and a bottom surface, wherein the bottom surface has a channel defined therein and the sidewall has at least one opening extending therethrough and communicating with the channel;

a liquid impermeable liner disposed across said bottom surface of said unitary base and conforming to the contour thereof including said channel wherein an upper and lower surface of an outer edge of said liner is embedded in said sidewall;

a lip seal adapter disposed in said sidewall opening, wherein a periphery of said lip seal adapter is embedded in said sidewall opening; and a flexible annular seal member disposed in said sidewall opening and securingly interposed between said liner and said lip seal adapter.

16. The canal-bed as specified in claim 15, wherein said opening of said unitary base includes a shouldered portion defined between said seal and said channel to form a socket into which a sewer tube can be abutted.

17. The canal-bed as specified in claim 15, wherein the depth of said channel is approximately one-half the diameter of said wall opening.

18. The canal-bed as specified in claim 15, wherein said channel has an arcuate cross section.

19. The canal-bed as specified in claim 15, wherein said liner has an integral socket extending partially into said sidewall opening and positioned adjacent said annular seal.

20. The canal-bed as specified in claim 15, wherein said sidewall has a second opening in communication with said channel.

21. The canal-bed as specified in claim 15, wherein both said liner and said insert are formed of molded plastic material.

22. A method of forming a concrete manhole base having a canal-bed liner, said method comprising the steps of:

(a) providing a vertical mold column having a top surface;

(b) positioning a liquid impermeable canal-bed liner across said mold column top surface such that a periphery of said liner extends radially beyond said mold column top surface, said liner having an annular sidewall, a channeled bottom, and a socket extending from said annular sidewall;

(c) positioning a plug within the socket of said liner;

(d) positioning an outer wall mold member concentrically about said vertical mold column to define a spacing between said mold column and said outer wall mold member, wherein said outer wall mold member extends above said mold column top surface;

(e) pouring concrete into said spacing to fill said spacing, with said periphery of said liner embedded in said concrete and the bottom of said liner being covered with concrete;

(f) allowing sufficient time for said concrete to harden, whereby a portion of the concrete takes on said predetermined cross sectional shape; and (g) removing said mold column and said outer wall mold member from a resulting concrete manhole base.

* * * * *